US005168765A

United States Patent [19]

Broussard

[11] Patent Number: 5,168,765

[45] Date of Patent: Dec. 8, 1992

[54] WATER SAMPLER

[76] Inventor: Patrick M. Broussard, P.O. Box 55, Lakeland, La. 70752

[21] Appl. No.: 644,556

[22] Filed: Jan. 23, 1991

[51] Int. Cl.[5] ..... E21B 49/08

[52] U.S. Cl. ..... 73/864.74; 175/21; 175/22

[58] Field of Search ..... 73/863.23, 864.43, 864.74; 175/59, 21, 23, 22, 20

[56] References Cited

U.S. PATENT DOCUMENTS

| | | | |
|---|---|---|---|
| 58,721 | 10/1866 | Duck et al. | 175/22 |
| 576,953 | 2/1897 | Davis | 175/23 |
| 1,202,966 | 10/1916 | Carroll | 166/116 |
| 1,514,585 | 11/1924 | Edwards | 166/116 |
| 2,070,836 | 2/1937 | Macready | 166/264 |
| 2,141,261 | 12/1938 | Clark | 73/864.74 X |
| 2,161,233 | 6/1939 | O'Neill | 73/155 |
| 4,310,057 | 1/1982 | Brame | 73/864.74 X |
| 4,669,554 | 6/1987 | Cordry | 175/59 |
| 4,804,050 | 2/1989 | Kerfoot | 73/864.74 X |
| 4,807,707 | 2/1989 | Handley et al. | 73/864.74 X |

*Primary Examiner*—Hezron E. Williams
*Assistant Examiner*—Michael J. Brock
*Attorney, Agent, or Firm*—Jacobson, Price, Holman & Stern

[57] ABSTRACT

An upstanding tubular housing is provided mounted in sealed connection to the lower end of a tubing string as a downward extension thereof and encloses a screen sample tube therein for movement between an upper limit position with the lower end of the tube closing a center bore formed through a cone point on the lower end of the housing and a lower limit position with a major portion of the length of the screen tube downwardly projected through said center bore. A drop rod is downwardly insertable through the tubing string and engageable with the upper end of the screen tube for downwardly displacing the latter from its upper limit position to its lower limit position and the drop rod is tubular and defines an upward extension of the interior of the screen tube. Lower and upper end portions of the screen tube are sealed relative to the center bore when the screen tube is in its upper and lower limit positions, respectively, and the upper end of the interior of the screen tube includes a one-way check valve therein allowing and preventing upward and downward fluid flow, respectively, therepast.

8 Claims, 2 Drawing Sheets

WATER SAMPLER

BACKGROUND OF THE INVENTION

1. Field of the Invention

This invention relates to an apparatus which may be attached to the lower end of a tube shaft and driven downwardly into the ground to a point immediately above a ground layer from which a water sample is to be taken. The apparatus itself is tubular and includes a tubular sampler which maybe downwardly projected therefrom through the utilization of a drop rod extending downwardly through the tube shaft and engageable with the sampler for projection thereof downwardly into the aforementioned ground layer for intaking ground water therefrom for passage upwardly into the tubular apparatus from which the sampler was downwardly extended.

2. Description of Related Art

Various different forms of ground water samplers heretofore have been provided such as the "HYDROPUNCH" and "HYDROPUNCH II" marketed by QED Ground Water Specialists of Ann Arbor, Mich. However, these water samplers are not constructed and operative in a manner to obtain water samples which are at least substantially uncontaminated from the ground layers disposed immediately above the ground layer from which the water sample is obtained.

SUMMARY OF THE INVENTION

The water sampler of the instant invention is driven down into the ground to the upper extremity of the ground layer from which the water sample is to be taken and a screen-type sampler is then driven downwardly therefrom into the ground layer from which the water sample is to be taken. The static pressure of the water in the ground layer from which the sample is being taken forces the sample water up through the screen-type tubular sampler and into the interior of the tubular apparatus from which the screen-type water sampler was downwardly extended. If desired, the apparatus may include a check valve for retaining the sample water therein, or a sampler cup or the like may be downwardly inserted through the tube shaft and into the apparatus for obtaining a sample of the water therein. After the water sample has been obtained, the entire tube shaft, apparatus and screen-type water sampler previously downwardly extended from the apparatus is upwardly withdrawn from the ground.

Existing sampling apparatus always travel into the zone of sampling before the screen unit thereof is exposed. Therefore, depending upon the conditions of entry before the sample zone is encountered, a possibility of cross contamination exists.

A better defined, undisturbed sample is desired since the parameters of the present regulatory agency have significantly low levels.

With the sampler of the instant invention, after the apparatus has been forced to the level from which water is to be sampled, the screen unit is mechanically downwardly projected relative to the apparatus and the sampler, therefore, is exposed to the surrounding ground only after the screen unit or tube is driven into the subsurface layer from which sample water is to be taken.

The water sampling apparatus of the instant invention enables a direct connection with the surface and any desired subsurface interval. Samples can be taken using innovative equipment and techniques for direct measurements during field operations for subsurface investigations.

The present invention incorporates a ground water and soil gas sampling apparatus and enables a new method of sampling ground water and soil gas. The apparatus has a sampler cylindrical housing which is adapted to be inserted in the subsurface to obtain a sample at a selected interval. The apparatus includes a cylinder housing which encloses a screen unit and sample chamber. The apparatus is provided with a two piece drive cone adapted to penetrate the subsurface, the outer cone section being apart of the cylindrical housing and the inner cone section being apart of the lower end of the screen unit. The screen unit communicates with the chamber for delivering the received ground water or gas sample. The screen unit is enclosed within the cylinder housing from the subsurface upon descent, therefore isolating the screen unit from ground layers through which the sample cylinder is downwardly forced until the selected level of sample is achieved. When the desired level is achieved, an inner activator rod is inserted through the tubular string until connection is made with the top end of the screen unit and the activator rod is thereafter utilized to downwardly displace the screen unit relative to the cylinder housing for exposure to the ground layer from which the sample is to be taken.

The sample can be obtained by pumping or vacuum lift directly from the screen unit through the tubular activator rod thereby enabling a valuable pump test to be performed directly from the zone of sampling. Vapor analysis can be achieved directly in the field as operations progress. Samples also can be taken by retrieving the activator rod thus allowing the ground water samples to the sample chamber in the top of the cylindrical housing. Sampling equipment then can be lowered through the thrust rod or drill string into the top sample chamber of the cylindrical housing in order to obtain a sample. Ground water may communicate to the sample chamber and means can be provided for preventing the collected sample from reversibly passing from the apparatus during withdrawal from the sampled interval.

The apparatus can be driven into the subsurface by any suitable means such as a hydraulic ram to any depth desired by attaching it to the end of thrust rods or drills string sections. The apparatus can be reused after each bore hole and provides for quick decontamination due to a parts reduction.

The method used with the apparatus includes inserting the device into the subsurface at a selected interval. During insertion a two cone piece is used for penetration and a cylindrical housing that pushes the two cone piece during insertion. After the apparatus is positioned into the subsurface desired, the method includes utilization of a push rod through the tubular string into the cylindrical housing where contact connection is made with the screen unit which carries the center cone of the two cone piece used for ground penetration. After connection is achieved, the rod pushes the screen unit into the sample interval to retrieve the sample. The sample can be obtained through the tubular push rod for direct measurements, or the push rod can be retrieved and sampling equipment lowered into the upper sample chamber of the cylindrical housing. Finally, a sample can be taken by sealing the sample in the sample chamber followed by withdrawal of the entire apparatus.

As can be appreciated, the method involved with this invention provides a simple, inexpensive and quick procedure to obtain ground water or soil gas samples from any desired depth. Since the sampling inlet remains enclosed by the cylindrical housing and the cylindrical housing that contacts upper layers downwardly through which the sampler is forced, upper ground material never enters the zone of sampling to thereby prevent the introduction of foreign contaminants in the sample.

The inserting step of the apparatus also may include inserting the apparatus in a previously drilled bore hole and extending the screen sampler at a desired sampling interval or depth.

The main object of this is to provide a sampler for and method of sampling subsurface levels which enable the desired sample to be obtained with substantially no contamination.

Another object of this invention is to provide sampler which is first lowered to a level immediately above the sample level and which includes a sample obtaining screen tube enclosed within the sampler and downwardly extendable relative thereto, whereas other sampling units are lowered to the desired sampling level after which outer components thereof are upwardly retracted to expose an interior sampling component.

A further important object of the invention is to provide a sampler which has minimum of parts to be decontaminated between successive sampling operations in different ground areas.

A final object of this invention to be specifically enumerated herein is to provide a sampler in accordance with the preceding objects which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
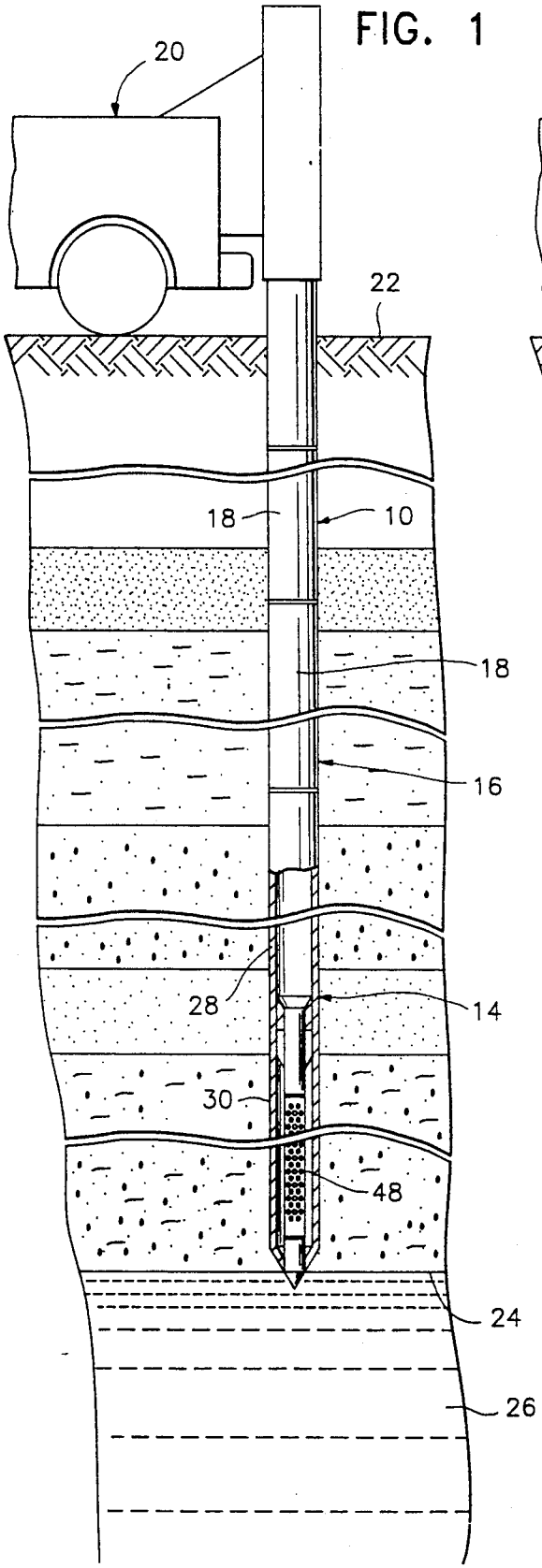
FIG. 1 is a fragmentary side elevational view illustrating the sampler of the instant invention in position lowered into the ground to the upper limit of a ground layer from which a sample is to be taken and with portions of the lower end of the sampler being broken away and illustrated in vertical section.
Figure 2:
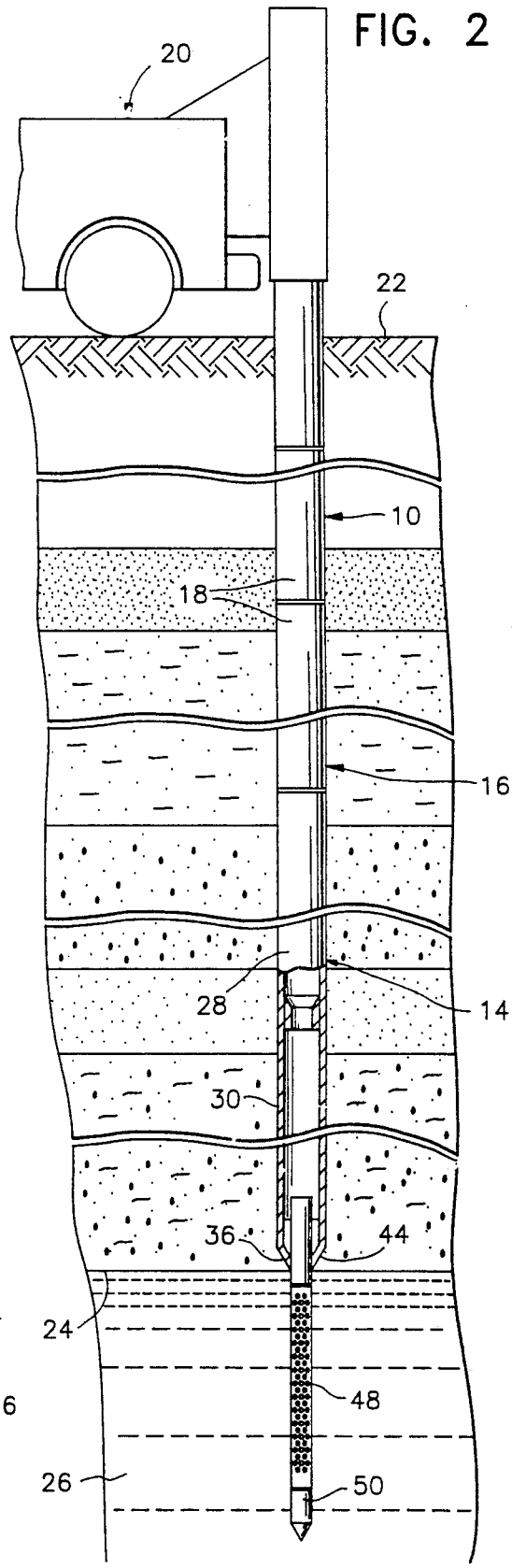
FIG. 2 is a fragmentary side elevational view to similar to FIG. 1, but with the screen sample tube of the sampler downwardly projected from the tubular housing of the sampler into the ground layer from which the sample is to be taken.

Referring now more specifically to the drawings the numeral 10 generally designates the sampler of the instant invention. In FIGS. 1 and 2 the sampler 10 includes a lower unit 14 mounted upon the lower end of a tube string 16 comprising a plurality of suitable interconnected tube string sections 18 with the upper end of the tube string being supported from a suitable ground surface unit referred to in general by the reference numeral 20 and capable of downwardly forcing the sampler 10 through the ground from the surface 22 to the upper extremity 24 of a ground layer 26 from which a water or gas sample is to be obtained.

Figure 3:
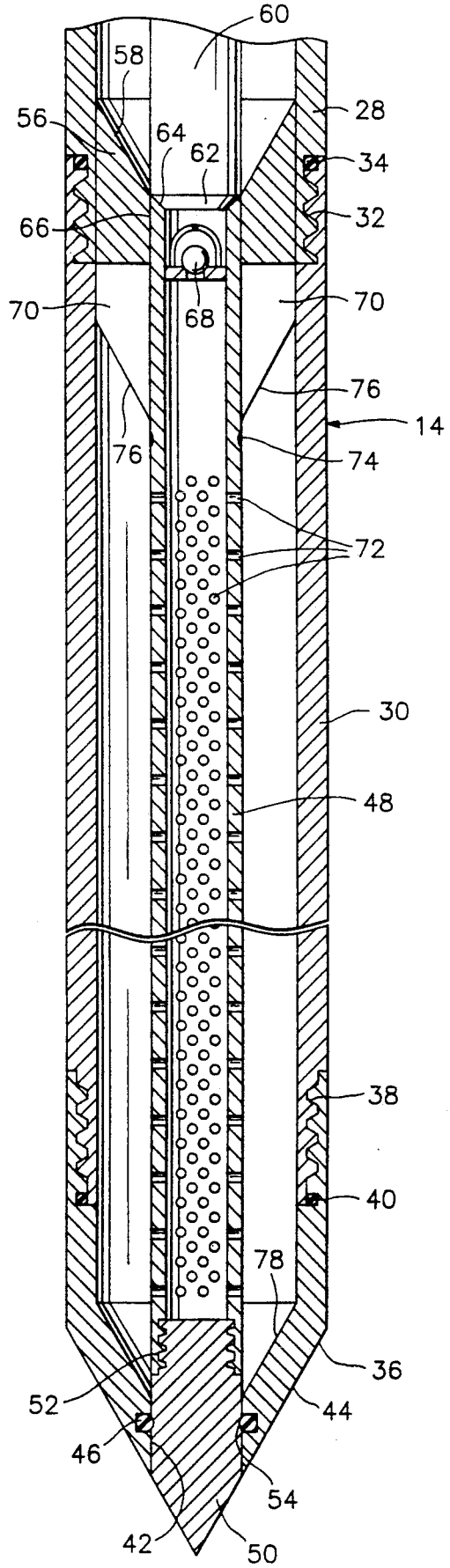
FIG. 3 is an enlarged fragmentary vertical sectional view of the sampler with the screen sample tube in a fully retracted position sealed within the tubular housing of the sampler and with the upper end of the screen sample tube being provided with a check valve and contacted by a tubular push rod by which the screen sample tube may be downwardly extended relative to the tubular housing of the sampler.

As may be seen more clearly in FIG. 3, the lower unit 14 comprises a tubular housing having upper and lower sections 28 and 30 thereof removably threadedly joined as at 32 and sealed relative to each other as at 34.

The lower section 30 includes an outer cone member 36 removably threadedly secured to the lower end of the lower section 30 as at 38 and sealed relative thereto as at 40. The outer cone member 36 is tubular and includes a center bore 42 formed through the cone portion 44 thereof along its longitudinal center line, the cone portion 44 including a 0-ring seal 46 supported therefrom projecting slightly into the center bore 42. Disposed within the lower section 30 is a screen sample tube 48 having a solid inner cone member removably threadedly engaged in its lower end as at 52 and the outer surface of the inner cone member 50 includes a slight circumferential groove 54 extending thereabout in which the inner periphery of the 0-ring seal 46 is sealingly seated, the outer cone member 36 and the inner member 50 together forming a ground penetration cone for the lower end of the lower unit 14.

The interior of the lower end of the upper section 28 is provided with a stationary internal abutment sleeve 56 and the upper end of the abutment sleeve 56 includes a tapered counter bore 58. A tubular push rod 60 has its lower end disposed within the upper section 28 and the lower terminal end of the push rod 60 is beveled as at 62. The beveling of the lower end of the push rod 60 at 62 substantially matches the beveling 64 of the upper end of the screen sample tube 48. The upper end of the screen sample tube 48 is slidingly received through the bore 66 formed through the abutment sleeve 56 and includes a one way valve 68 enabling a liquid or gas sample to pass upwardly through the screen sample tube 48 and into the interior of the push rod 60 or the interior of the upper section 28 which defines a sample chamber above the one way valve 68.

The upper end of the screen sample tube is provided with radial vanes 70 including upper ends contacted by the undersurface of the abutment sleeve 56 and the screen sample tube is provided with a plurality of inlet openings 72 spaced thereabout and longitudinally therealong. In addition, the upper end of the screen sample tube 48 also includes a circumferential groove 74 corresponding to the circumferential groove 54.

The lower ends of the vanes 70 are tapered as at 76 and the interior of the cone portion 44 of the outer cone member 36 includes a corresponding internal taper 78 to thereby enable the lower ends of the vanes 70 to abuttingly contact the inner surfaces of the cone portion 44. When the tapered edges 76 of the vanes 70 contact the tapered inner portion 78 of the cone portion 44, the circumferential groove 74 is registered with the 0-ring seal 46.

In operation, the unit 22 is utilized to force the sampler 10 down to the upper extremity 24 of the zone, interval or ground layer 26. Then, the push rod 60 is downwardly inserted through the tubing string 18 and contacted with the upper end of the screen sample tube 48.

At this point, the cone portion 44 is disposed only at the upper extremity 24 and thus the ground layer or interval 26 has not been contaminated by any portion of the sampler 10 above the inner cone member 50. At this point, the push rod 60 is utilized to downwardly project the screen sample tube from the outer cone member 36 and into the interval 26. If static pressure in the interval 26 is sufficient, the water or gas sample to be taken will enter through the bores 72, pass upwardly through the screen sample tube and into the push rod 60. The sample may then be pumped or vacuumed from the interior of the pump rod 60 to the surface 22. Otherwise, the push rod 60 may be removed and static pressure of the fluid being taken will cause the fluid to pass upwardly into the upper section 28 whose interior comprises a sample chamber. Then, the entire sampler 10 may be withdrawn from the ground with the one way valve 68 maintaining the fluid sample within the upper section 28. Of course, if the push rod 60 is removed, a vacuum or pump also may be used to extract the sample from the interior of the upper section 28, or, if the sample being taken is liquid, a sample retriever may be downwardly inserted through the tubing string 16 and into the upper section 28 for obtaining the desired sample.

From the above it may be seen that a liquid or gas sample may be taken from the level or interval 26 which is substantially uncontaminated. Further, upon completion of taking the sample, the entire sampler 10 may be upwardly withdrawn from the ground leaving no part of the sampler within the ground.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. In combination, a gas/water sampler including a tubular housing having open top and bottom ends with said upper end adapted for sealed securement to the lower end of a tubing string as a downward extension thereof, said tubular housing including a downwardly tapered lower ground penetrating cone thereon including a central bore therethrough, a tubular screen sample tube including upper and lower ends disposed in an upper position within said tubular housing and including a lower end plug snugly received in, slidable downwardly through and closing said central bore, said sample tube being downwardly projectable from said upper position through said central bore to a lower position with said upper end disposed within a lower portion of said tubular housing, said upper end of said sample tube and said tubular housing including coacting abutment means preventing upward and downward movement of said sample tube in said housing above and below, respectively, said upper and lower positions, a drop rod downwardly insertable through the open top end of said tubular housing and abuttingly engageable with the upper end of said sample tube for forcing said sample tube downwardly relative to said tubular housing from the upper position thereof to the lower position thereof, said drop rod being tubular and is abuttingly engageable with the upper end of said sample tube in a manner defining an upward extension of the interior thereof.

2. The combination of claim 1 wherein said plug tapers downwardly and forms a downward continuation of the taper of said cone outwardly of said bore when said sample tube is in said upper position.

3. The combination of claim 1 wherein said plug and cone include coacting means sealing said plug in said bore when said sample tube is in said upper position.

4. The combination of claim 1 wherein said sample tube and cone include coacting means sealing said sample tube in said bore when said sample tube is in said lower position.

5. The combination of claim 1 wherein the last mentioned coacting means also includes means sealing said plug in said bore when said sample tube is in said upper position.

6. The combination of claim 1 wherein the upper end of said sample tube is provided with a one-way valve operative to allow upward fluid flow therepast and to prevent downward fluid flow therepast.

7. The method of obtaining a gas/water sample of a below ground level area, said method including providing a gas/water sampler including a tubular housing having open top and bottom ends and with said top end sealingly secured to the lower end of a tubing string as a downward extension thereof, said tubular housing including a downwardly tapered lower ground penetrating cone thereon including a central bore therethrough, a tubular screen sample tube including upper and lower ends disposed in an upper position with said tubular housing and including a lower end plug snugly received in and slidable downwardly through said central bore, said sample tube being downwardly projectable from said upper position through said central bore to a lower position with said upper end disposed within said tubular housing, said upper end of said sample tube and said tubular housing including coacting abutment means preventing upper and downward movement of said sample tube in said housing above and below, respectively, said upper and lower positions, downwardly displacing said tubing string into the ground to a position with said cone disposed at least substantially at said below ground level, downwardly inserting a drop rod through said tubing string into abutting engagement with said upper end of said sample tube, forcing said drop rod further downwardly relative to said tubing string to cause said sample tube to be shifted from said upper position to said lower position, and allowing the fluid within the ground disposed about the downwardly projected portion of said sample tube to enter the latter and to move upwardly therethrough into the interior of said tubular housing, and obtaining a sample of the fluid upwardly introduced into said tubular housing through said sample tube and thereafter upwardly removing said tubing string and sample tube from the ground, said drop rod being tubular and abuttingly engageable with the upper end of said sample tube to define an upward extension of the interior thereof, said method further including the step of drawing the sample fluid upwardly introduced into said housing through said sample tube upwardly through the interior of said drop rod to the surface of the ground.

8. The method of obtaining a gas/water sample of a below ground level including providing a gas/water sampler incorporating a tubular housing having open top and bottom ends with the open top end sealed relative to the lower end of a tubing string as a downward extension thereof and with said tubular housing enclosing a tubular screen sample tube therein having upper and lower ends with the lower end thereof closing said bottom end and said screen sample tube being partially downwardly displaceable through said bottom end, downwardly displacing said tubular string and tubular housing to the upper extremity of a ground layer from which a gas/water sample is to be taken, passing a drop rod downwardly through said tubing string into engagement with the upper end of said sample tube, applying a downward force on said drop rod sufficient to downwardly displace the drop rod and said sample tube relative to said housing to a position with said sample tube projecting sufficiently outward of said bottom end to receive a gas/water sample thereinto for movement of the sample upwardly through the sample tube and into the interior of said housing, and retrieving said sample from the interior of said housing above said upper end through said tubing string and then upwardly removing said tubing string and housing as well as said sample tube from the ground, said drop rod being tubular and abuttingly engageable with the upper end of said sample tube to define an upward extension of the interior thereof, said method further including the step of drawing the sample fluid upwardly introduced into said housing through said sample tube upwardly through the interior of said drop rod to the surface of the ground.

* * * * *